United States Patent [19]

Thiem et al.

[11] 4,240,174

[45] Dec. 23, 1980

[54] SELF-CONTAINED MOBILE POOL CLEANING APPARATUS

[76] Inventors: James F. Thiem, 3610 E. Coolidge, Phoenix, Ariz. 85018; Jeffrey L. Scott, 13008 N. 28th Pl., Phoenix, Ariz. 85032

[21] Appl. No.: 61,820

[22] Filed: Jul. 30, 1979

[51] Int. Cl.[3] ..... E04H 3/20

[52] U.S. Cl. ..... 15/1.7; 210/169; 210/241

[58] Field of Search ..... 15/1.7, 353; 210/169, 210/241, 416 R

[56] References Cited

U.S. PATENT DOCUMENTS

| | | | |
|---|---|---|---|
| 279,572 | 6/1883 | Leaycraft | 15/353 |
| 2,646,889 | 7/1953 | Dulak | 15/1.7 |
| 3,006,020 | 10/1961 | Fillery | 15/353 |
| 3,012,676 | 12/1961 | Englesberg | 210/241 |
| 3,221,888 | 3/1965 | Muller | 210/340 |
| 3,273,188 | 9/1966 | Levack | 15/1.7 |
| 3,291,562 | 12/1966 | Anderson | 210/340 |
| 3,360,816 | 1/1968 | Fontecchio | 15/1.7 |
| 3,509,589 | 5/1970 | Bond | 15/1.7 |
| 3,679,060 | 7/1972 | Smith | 210/333 |
| 3,868,739 | 3/1975 | Hargrave | 15/1.7 |
| 3,886,616 | 6/1975 | Hayes | 15/1.7 |
| 3,940,817 | 3/1976 | Levack | 15/1.7 |
| 3,942,217 | 3/1976 | Bates | 15/321 |
| 3,950,809 | 4/1976 | Schatzmann | 15/1.7 |
| 3,977,421 | 8/1976 | Fallen | 134/6 |
| 4,064,586 | 12/1977 | Caron | 15/1.7 |
| 4,142,270 | 3/1979 | Nauta | 15/353 |

*Primary Examiner*—Theodore A. Granger
*Attorney, Agent, or Firm*—Warren F. B. Lindsley

[57] ABSTRACT

A mobile cleaning apparatus for swimming pools having a self-contained pump, filter and driving motor mounted on a hand wheeled truck and housed in a waterproof enclosure which is easily opened for filter cleaning and motor and pump repairs, if necessary, to assure a long service life of the apparatus.

1 Claim, 9 Drawing Figures

FIG. 5
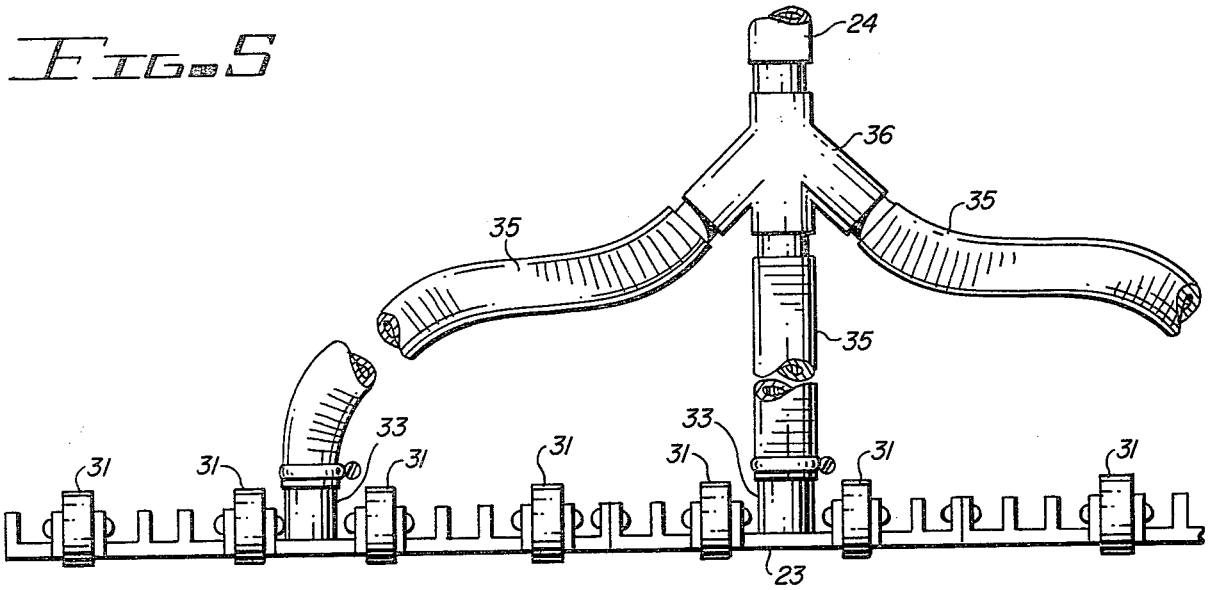
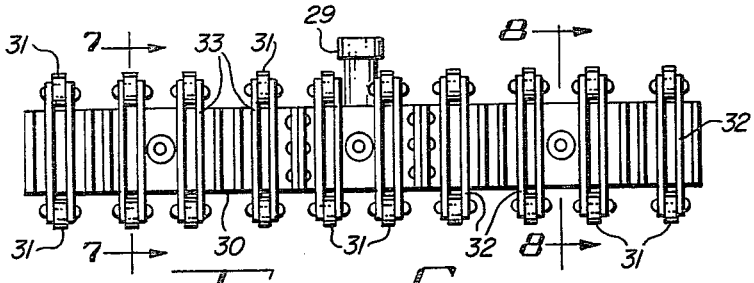
FIG. 6
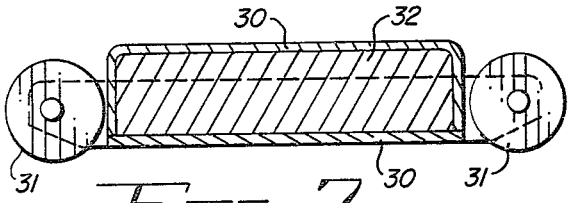
FIG. 7
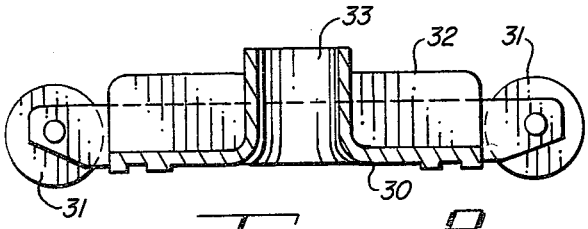
FIG. 8
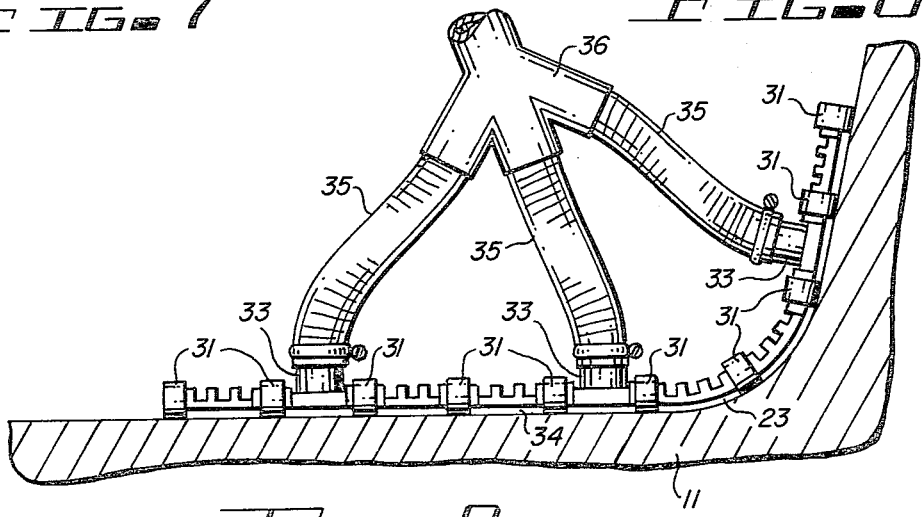
FIG. 9

SELF-CONTAINED MOBILE POOL CLEANING APPARATUS

BACKGROUND OF THE INVENTION

With the increased construction of swimming pools, a need has arisen for a simple, portable vacuum cleaning device which may be periodically connected to the water of the swimming pool to filter and freshen it. Most devices of this nature comprise large filtering units including cumbersome recirculating pumps and motor which are hard to move to and from a pool's periphery and particularly if used by a maintenance organization many times a day.

The maintenance of a private swimming pool especially in regard to its water cleaning system is a complex, timeconsuming and expensive routine when handled by pool servicing organizations.

During the warmer seasons in particular, pool maintenance including sweeping of its walls, checking the pH level and chlorine content is a repetitive routine sometimes involving an hour or more of the owner or service organization's time each time it is performed. Unless these maintenance matters are carefully undertaken, however, the dirt on the bottom and sides of the pool will induce bacteria and algae growth in the pool with the resulting hazard to health, staining of the pool walls, etc. In addition, the water and the surface of the pool become permanently discolored and unsightly.

Not only are the foregoing routines time consuming, they additionally tend to bewilder the average pool owner and if he fails to follow the proper pool maintenance procedures faithfully, corrective measures must be taken which are even more time consuming and expensive.

Accordingly, pool servicing organizations are taking over more of the pool cleaning and maintenance functions of the home pool owner. Since the time consumed in cleaning and maintaining the average pool must be kept to a minimum by these service organizations in order for the average pool owner to afford this kind of service, new and modern mobile pool vacuum cleaning equipment is needed. Thus, pool maintenance organizations are turning to self-contained equipment which they can quickly move to pool side to perform the cleaning function, immediately clean its filters, if necessary and then truck mounted it for movement to other pool sites on the service man's route.

DESCRIPTION OF THE PRIOR ART

U.S. Pat. No. 3,012,676 discloses a liquid purifier comprising a portable filter and water aerator having a self-contained pump and driving motor mounted on a hand-wheeled truck.

U.S. Pat. No. 3,942,217 discloses a portable carpet cleaning machine utilizing an auxiliary dirty fluid collecting means mounted on a separate wheeled auxiliary frame.

U.S. Pat. No. 3,273,188 discloses a vacuum head for sweeping swimming pools using only one vacuum hose connection.

U.S. Pat. No. 3,360,816 discloses an articulated sweeper head for vacuum cleaning a swimming pool having a plurality of vacuum hoses connected to the head.

U.S. Pat. Nos. 3,221,888; 3,291,562 and 3,679,060 disclose cleaning device employing more than one filter mechanism.

U.S. Pat. No. 3,977,421 discloses a buffing machine comprising a rotary buffing element, internal combustion engine for driving the buffing element and a fuel tank for liquified gas all frame mounted on traction wheels.

SUMMARY OF THE INVENTION

In accordance with the invention claimed, an improved self-contained mobile pool cleaning apparatus is disclosed for use in the purification and cleaning of swimming pools, the system comprising an improved housing for containing in a unitary configuration a plurality of removable filter elements for easy servicing and cleaning so as to more effectively clean a plurality of pools each day with a minimum if any down time for apparatus maintenance.

It is, therefore, one object of this invention to provide an improved self-contained mobile vacuum cleaning apparatus for a swimming pool.

Another object of this invention is to provide such an apparatus which is suitable functionally and economically for use in small private pools by a service organization.

A further object of this invention is to provide an improved housing for containing a plurality of the apparatus components in an easily accessible arrangement for ease in servicing.

A still further object of this invention is to provide a self-contained pool cleaning device in a simple mobile form which may be truck mounted and dismounted easily by a single operator.

A still further object of this invention is to provide such an apparatus which is inexpensive to manufacture and which may be sold at a price which is not prohibitive for the average pool servicing organization.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawing, in which:

FIG. 5 is an enlarged partial view of a wand and sweeper end for attachment to the apparatus shown in FIG. 1;

FIG. 6 is a top view of the sweeper head shown in FIG. 5;

FIG. 7 is a cross-sectional view of FIG. 6 taken along the line 7—7;

FIG. 8 is a cross-sectional view of FIG. 6 taken along the line 8—8; and FIG. 9 is a partial cross-sectional view of the bottom and side of a swimming pool showing the flexibility of the sweeper head of the apparatus.

DESCRIPTION OF THE PREFERRED EMBODIMENT

Figure 1:
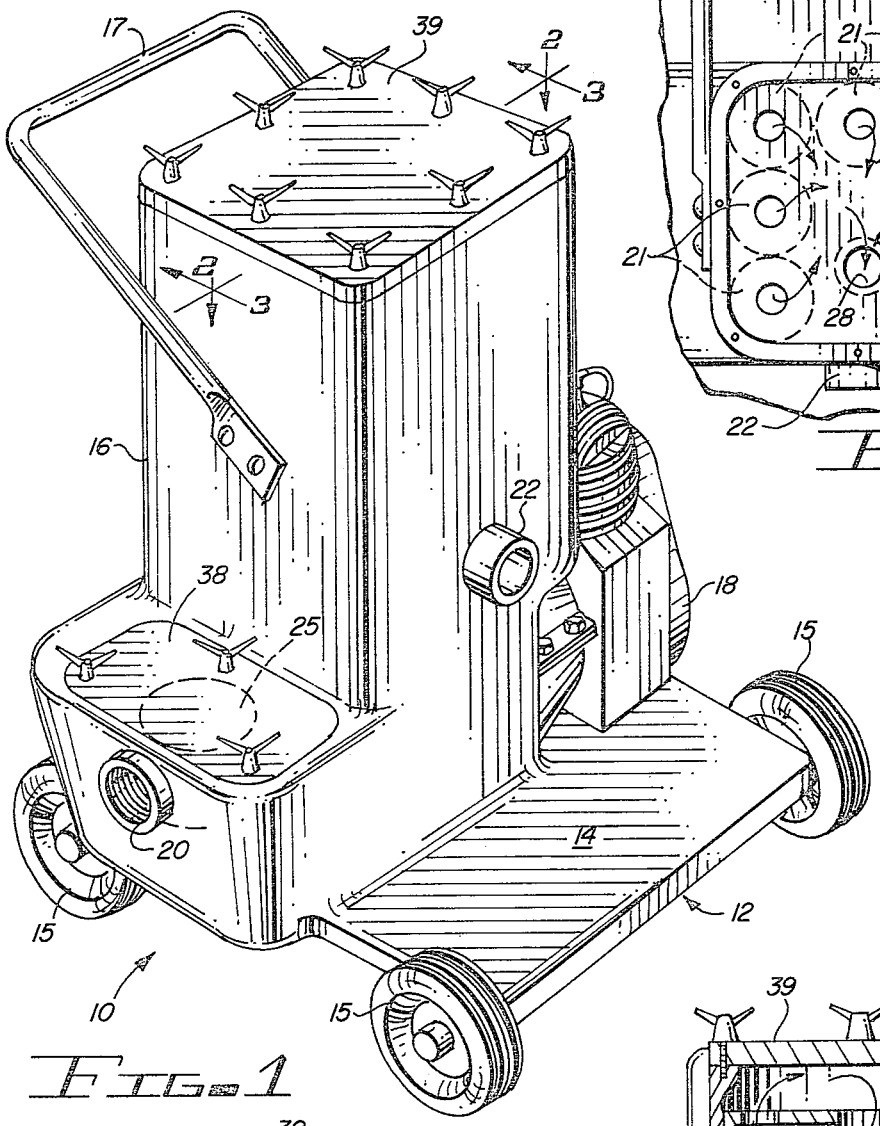
FIG. 1 is a perspective view of a self-contained mobile vacuum cleaning and water filtering apparatus embodying the invention.
Figure 2:
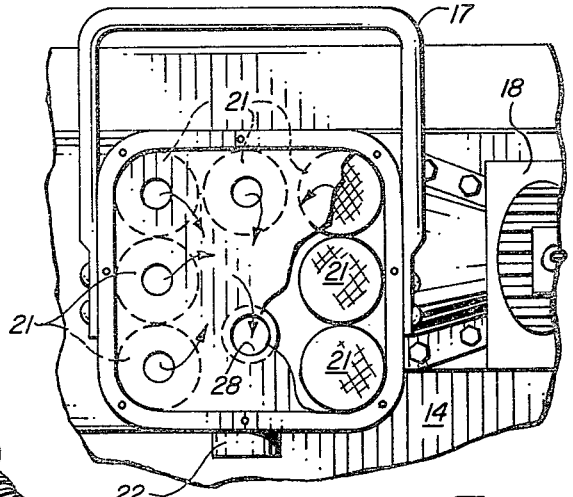
FIG. 2 is a cross-sectional view of FIG. 1 taken along the line 2—2.
Figure 4:
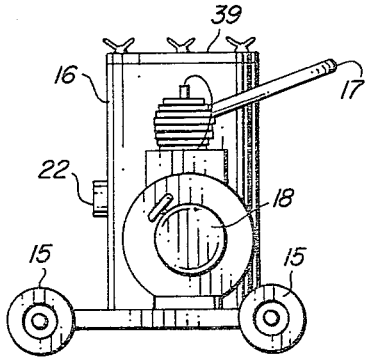
FIG. 4 is a right end view of FIG. 1.
Figure 3:
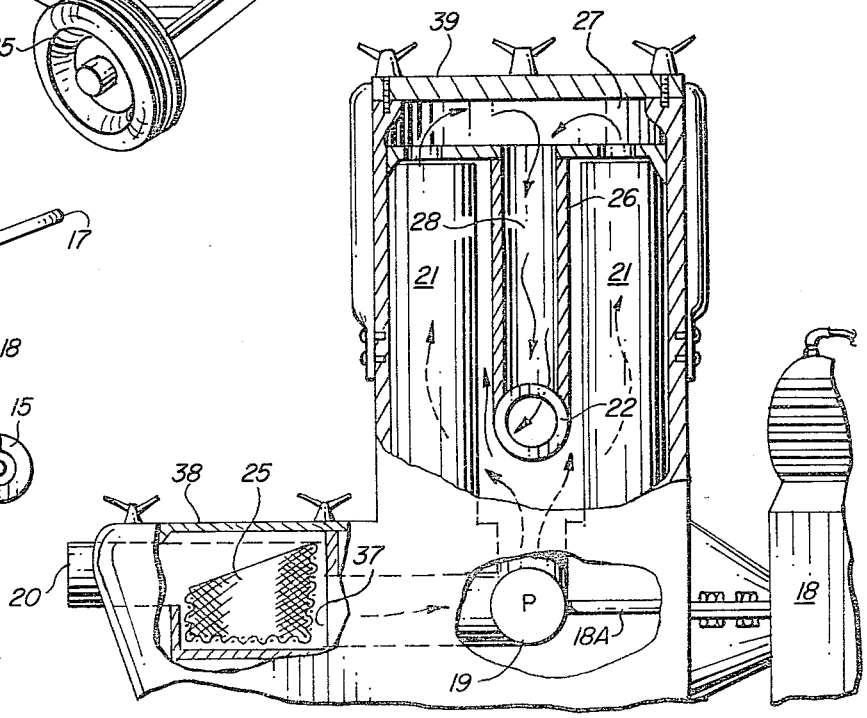
FIG. 3 is a cross-sectional view of FIG. 1 taken along the line 3—3.

Referring more particularly to the drawing by characters of reference, FIGS. 1–6 disclose an improved mobile self-contained pool maintenance apparatus 10 especially devised for use in the cleaning and purification of swimming pools 11 shown in FIG. 9 and comprises a mobile cart 12 employing a frame having a base 14, two pairs of pneumatic wheel mounted tires 15 journaled for rotation one tire at each corner of the base and a housing 16 vertically positioned on base 14 and having a U-shaped hand gripping member 17 extending laterally therefrom as shown in FIG. 1.

Apparatus 10 comprises a suitable motor such as an electric or gasoline motor 18 for driving a pump 19 which is used for drawing pool water and debris from the pool through inlet port 20 and one or more cartridge filters 21 before returning it to the pool through outlet port 22 during a pool vacuum cleaning operation.

As shown in FIG. 1, a suitable four horsepower Kohler gasoline engine 18 is illustrated for driving a 5800 gallon per hour pump for drawing pool water and debris through a vacuum sweeper head 23, flexible hose 24 (which is only partially shown), inlet port 20 of housing 16, a filter basket 25, pump 19, into a reservoir 26 between the filter and through a plurality of parallelly arranged filters 21 into a reservoir 27 at the top of housing 18 and back into the pool being cleaned through a passageway 28.

The sweeper head 23 is moved along the bottom and side walls of the pool in the usual manner by a hingedly mounted wand 29 detachably connected thereto and partially shown in FIG. 6. As noted from FIGS. 5–9, the sweeper head comprises a flexible wheel mounted frame 30 similar in many characteristics to the known sweeper heads in that it has a plurality of pairs of wheels 31 mounted along its length in a manner to position the flexible frame 30 of the sweeper closely adjacent the pool bottom on walls being cleaned. Further, a plurality of weights 32 are positioned laterally of its longitudinal axis at spaced positions to aid in holding the sweeper head on the surface being cleaned. At spacedly arranged positions along its length, vacuum hose connections 33 are provided which form passageways through the top of the sweeper head to the bottom thereof.

In the known manner, the bottom of the sweeper head forms a vacuum suction chamber 34 for drawing water and debris off of the surface being traversed by the sweeper head.

FIGS. 5 and 9 illustrate that the top ends of the sweeper head vacuum hose connections are interconnected by detachable flexible hose sections 35 through a plural hose connector 36 to the flexible hose 24, the other end of which is detachably connected through inlet port 20 to the interior of the filter basket assembly 25. Filter basket assembly 25 has an outlet port 37 which is connected to the inlet port (not shown) of the pump 19 in the usual manner.

Although the width of the sweeper head may be of any suitable length a thirty inch length has been found to be satisfactory for ease in handling and at the same time providing a much wider or longer sweeper head than presently available in the marketplace. Further, although three vacuum hose connections 36 and hose sections 35 have been shown, any two or more may be utilized. It has been found that three equally spaced connectors have been found to be satisfactory for a 30 inch long sweeper head providing a greater suction capability than that available in the marketplace.

It should also be noted that the desired weighted sweeper head provides a weighted structure which deforms as shown in FIG. 9 to easily grip the bottom of the pool yet flexibly deforms to closely hug the sharp curves or arcuate portions of the interconnecting bottom and side walls of the known pool configurations.

The disclosed apparatus is easily truck or bumper mounted since the self-contained mobile unit is hand truck mounted. This permits the professional service man to drive his truck or car to the customer's pool area and then wheel this apparatus to pool side where the pool and its water are cleaned without any waste of water.

Periodically, the filter basket 25 and the filters 21 may be taken out of housing 16 through covers 38 and 39, respectively, to be washed in the usual manner to clean them away from the customer's premises with a separate water supply.

It should be noted that not only has a compact unitary structure been provided having most of its parts contained within a molded housing, but the apparatus contains a plurality of easily removable filter cartridges. In this instance seven cartridges are shown all operating simultaneously in parallel to provide a filtering action. As noted from FIG. 3 the same pressure exists in each filter since the pump 19 discharges water into a reservoir 26 before it enters into and passes through the filter cartridges. Thus all of the cartridges should carry their equal share of the water and perform an equal filtering action.

The apparatus disclosed is easily serviced by merely removing covers 38 and 39 to retrieve the filter basket and the filter cartridges for cleaning purposes.

Although but a single embodiment of the present invention has been illustrated and described, it will be apparent to those skilled in the art that various changes and modifications may be made therein without departing from the spirit of the invention or from the scope of the appended claims.

What is claimed is:

1. A mobile self-contained vacuum cleaning apparatus for pools comprising:

a hand truck, a housing mounted on said truck, said housing defining inlet and outlet ports, a filter basket mounted in said housing for receiving water from said inlet port, a pump for drawing water through said inlet port and said basket into said housing, a first reservoir arranged in said housing to extend longitudinally thereof for receiving water from said pump, a second reservoir in said housing extending laterally thereof and connected to said outlet port, a plurality of filter cartridges mounted in said housing to extend longitudinally thereof in a substantially parallel arrangement for simultaneously receiving water from said first reservoir under pressure of said pump along substantially their full lengths, filtering it and passing the water out therefrom through common ends into said second reservoir and then through said outlet port, motor means for driving said pump, a flexible hose connected to said inlet port for drawing water into its outer end from a pool, a sweeper head, said sweeper head comprising an elongated resilient body having a plurality of pairs of rotatably mounted wheels for moving the sweeper head over the pool surface, flexible means for connecting said other end of said hose to said sweeper head, said flexible means comprising at least a pair of passageways spacedly connected to said sweeper head for drawing water through said sweeper head and into said hose from at least a pair of spaced points along said sweeper head, whereby said passageways deflect when the resilient body of said sweeper head deflects during movement to maintain a fluid-tight connection between said sweeper head and said connector, and a wand hingedly connectable to said sweeper head for moving it along the bottom and walls of a pool.

* * * * *